US005287156A

United States Patent [19]

Shikada et al.

[11] Patent Number: 5,287,156

[45] Date of Patent: Feb. 15, 1994

[54] FIXING DEVICE CAPABLE OF SEPARATING AN END PORTION OF A RECORDING MATERIAL BY A BEARING

[75] Inventors: Makoto Shikada, Kawasaki; Otoya Kosugiyama, Yokohama, both of Japan

[73] Assignee: Canon Kabushiki Kaisha, Tokyo, Japan

[21] Appl. No.: 845,164

[22] Filed: Mar. 3, 1992

[30] Foreign Application Priority Data

Mar. 19, 1991 [JP] Japan ..... 3-054447

[51] Int. Cl.[5] ..... G03G 21/00

[52] U.S. Cl. ..... 355/285; 271/119; 271/900; 355/282; 355/200

[58] Field of Search ..... 355/282, 285, 289, 290, 355/295, 200; 271/900, 272, 119; 29/123; 384/276, 625

[56] References Cited

U.S. PATENT DOCUMENTS

| | | | |
|---|---|---|---|
| 4,072,307 | 2/1978 | Knieser | 355/315 X |
| 4,269,504 | 5/1981 | Landa | 271/900 X |
| 4,399,598 | 8/1983 | Page et al. | 29/123 X |
| 5,048,168 | 9/1991 | Vanaschen et al. | 29/123 X |

*Primary Examiner*—Matthew S. Smith

*Attorney, Agent, or Firm*—Fitzpatrick, Cella, Harper & Scinto

[57] ABSTRACT

An image fixing device includes a fixing roller, a bearing for rotatably supporting the fixing roller, and a backup member to form a nip between them. The bearing extends to reach within a maximum recording material passage area of the fixing roller.

11 Claims, 10 Drawing Sheets

FIXING DEVICE CAPABLE OF SEPARATING AN END PORTION OF A RECORDING MATERIAL BY A BEARING

BACKGROUND OF THE INVENTION

1. Field of the Invention

The present invention relates to a fixing device for fixing an image on a recording material used in an image forming apparatus, such as an electrophotographic apparatus or an electrostatic recording apparatus.

2. Description of the Related Art

In recent years, heat roller fixing devices have been widely used as the fixing device used in an image forming apparatus.

To separate the recording material from a roller, the heat roller fixing device is generally provided with a plurality of separating claws.

The heat roller fixing device may be provided with a separation guide which is not in contact with the roller, as shown in FIG. 12.

In the fixing device shown in FIG. 12, a pressure roller 3 is pressed against a fixing roller 2 by a pressurizing means (not shown) to form a nip having a predetermined width. Fixing roller bearings 18 support the two end portions of the fixing roller 2. The fixing roller bearings 18 are disposed outside of a recording material passage area. A separation guide 10 is spaced from the fixing roller 2 by a predetermined interval and extends over the entire area of the fixing roller in the longitudinal direction thereof (in a direction perpendicular to the surface of the recording material).

Where the separation claws are provided, the number of parts required for the fixing device is increased.

Furthermore, both the adjustment of the contact force of the separation claws to the roller, and arrangement thereof are difficult. However, if they are not properly done, the separation claws may damage the surface of the roller.

Where the separation guide is used, a gap by which the separation guide is spaced from the fixing roller may vary depending on the variations in the components. If the gap is too large, separation failure may occur, causing jam of the recording material.

SUMMARY OF THE INVENTION

A primary object of the present invention is to provide an image fixing device which employs a lesser number of separation claws or no separation claw.

Another object of the present invention is to provide an image fixing device which can eliminate separation failure even when a separation guide, which is not in contact with the surface of a roller, is used.

Still another object of the present invention is to provide an image fixing device in which a bearing for rotatably supporting the roller extends to reach within a maximum recording material passage area.

To achieve the above-mentioned objects, the present invention provides an image fixing device which comprises a fixing roller, a bearing for rotatably supporting the fixing roller, and a backup member which forms a nip with the fixing roller. The bearing extends to reach within a maximum recording material passage area of the fixing roller.

In another embodiment, the present invention provides a fixing roller, with a bearing for rotatably supporting the fixing roller. The fixing roller has a maximum recording material passage area, with the bearing extending to reach within the maximum recording material passage area.

Other objects and features of the present invention will become obvious during the following discussion of the accompanying drawings.

DETAILED DESCRIPTION OF THE PREFERRED EMBODIMENTS

Embodiments of the present invention will now be described below with reference to the accompanying drawings.

Figure 1:
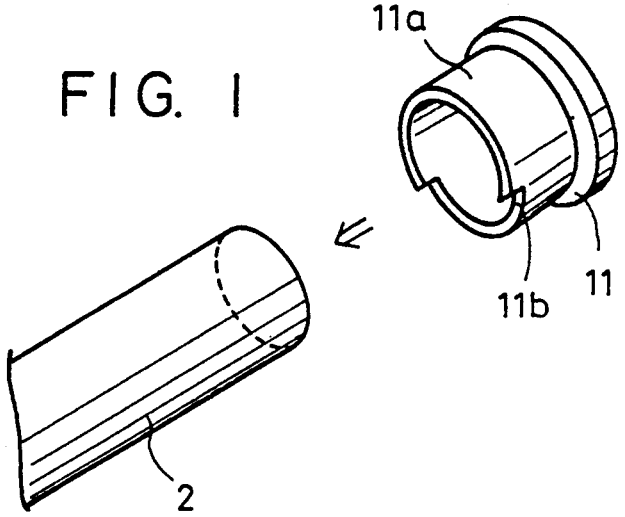
FIG. 1 is a perspective view of a bearing used in a first embodiment of the present invention.
Figure 2:
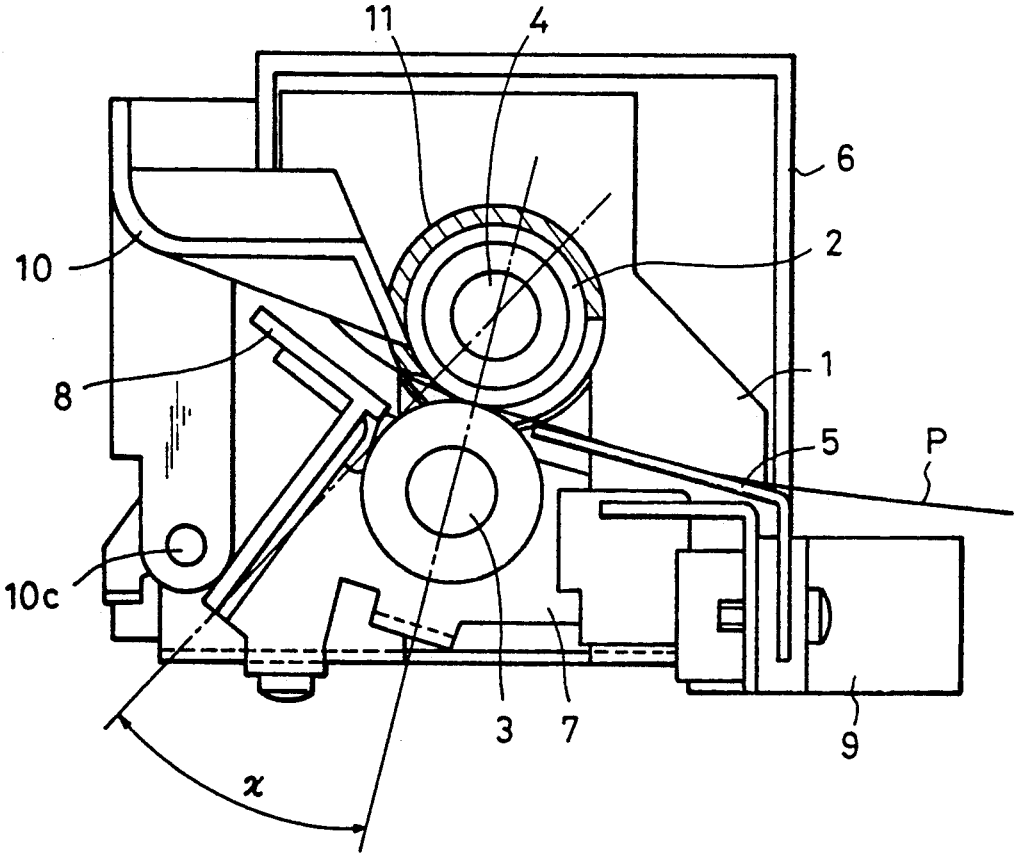
FIG. 2 is a cross-sectional view of a first embodiment of a fixing device according to the present invention.
Figure 3:
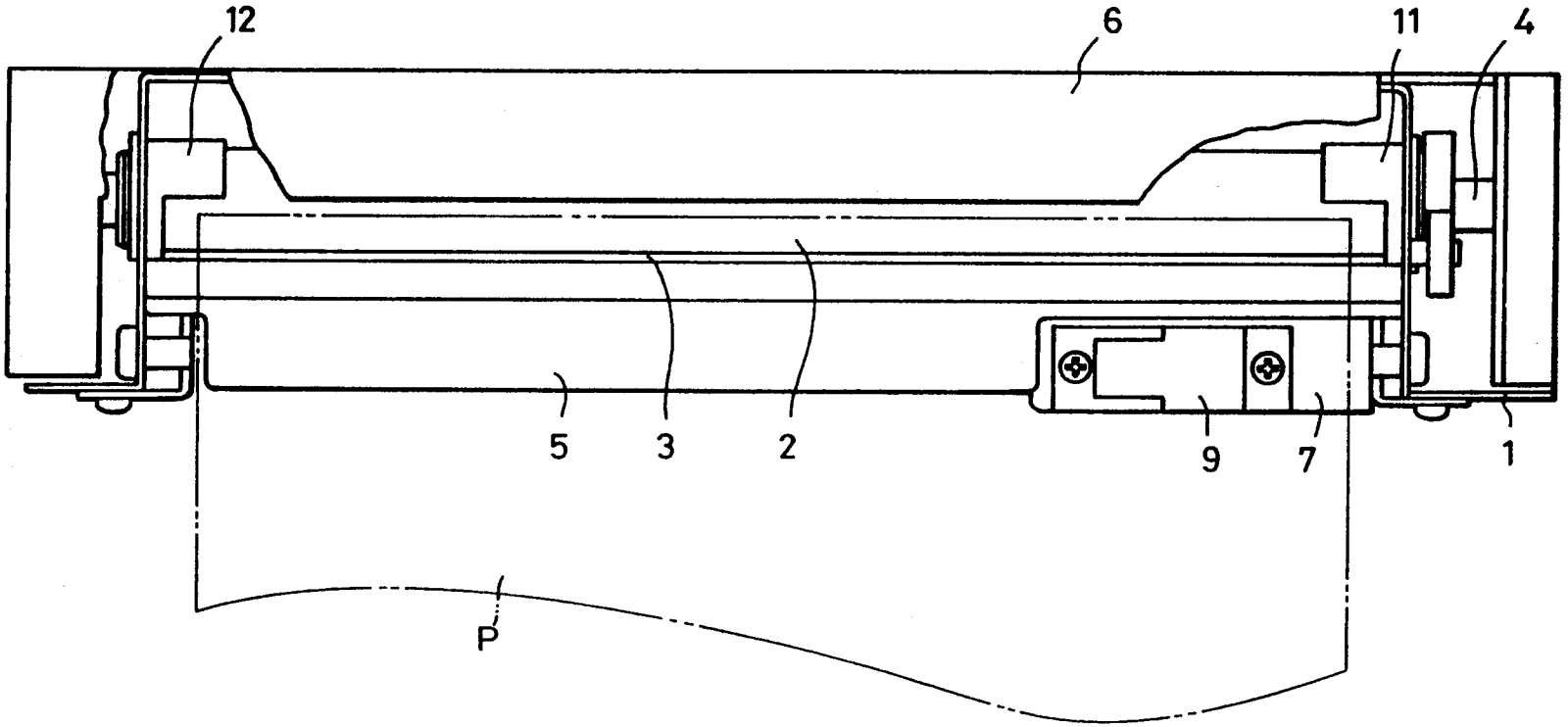
FIG. 3 is a front view of the fixing device shown in FIG. 2.
Figure 4:
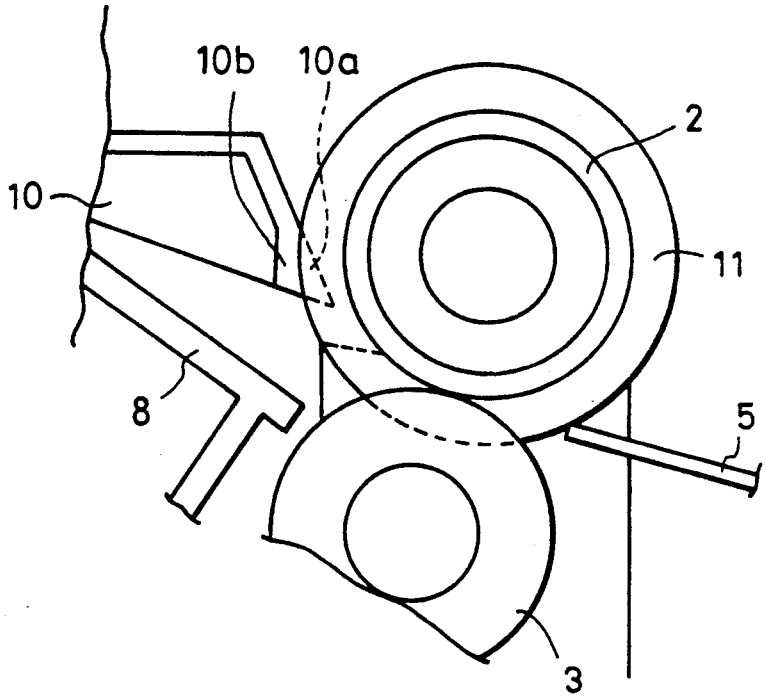
FIG. 4 is a cross-sectional view of the essential parts of the fixing device shown in FIG. 2.
Figure 5:
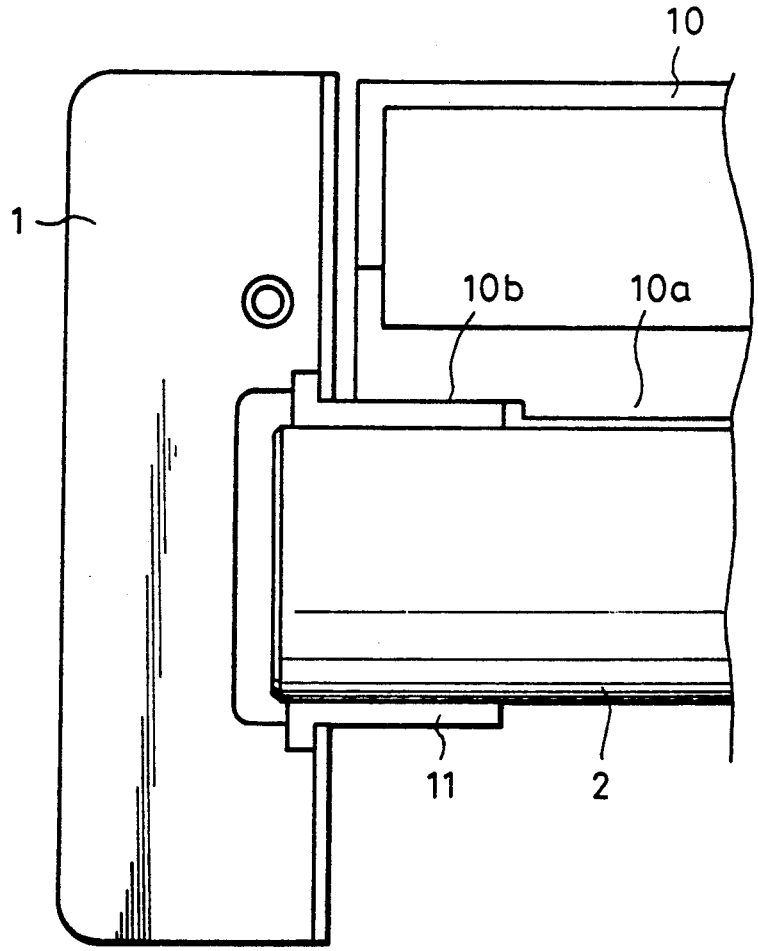
FIG. 5 is a cross-sectional view of the essential parts of the fixing device shown in FIG. 2.

A first embodiment of the present invention will be described first with reference to FIGS. 1 through 4. FIG. 1 is a perspective view of a bearing for a fixing roller. FIG. 2 is a cross-sectional view of a fixing device. FIG. 3 is a front view of the fixing device. FIG. 4 is a cross-sectional view of the essential parts of the fixing device.

The fixing device includes a fixing frame 1, and rollers used for fixing, one roller being a pipe-shaped fixing roller 2, which is brought into contact with a toner image which is not yet fixed, and the other being a pressure roller 3, which is pressed against the fixing roller 2. The fixing device further includes a halogen heater 4 for heating the fixing roller 2, and inlet guide 5, an upper cover 6, a pressure plate 7 for supporting the pressure roller 3 and for pressing the pressure roller 3 against the fixing roller through a pressing member (not shown), a paper discharge guide 8, a connector 9, a separation guide 10, and slide bearings 11 and 12 for slidably supporting the fixing roller. The slide bearings 11 and 12 are made of a resin. The resin is preferably a heat resistant resin. In addition, the pressure roller 3 may include a heating member.

Two end portions of the fixing roller 2 are supported by the fixing roller bearings 11 and 12 provided outside of and coaxially relative to the fixing roller 2. The fixing roller bearings 11 and 12 are supported and by the fixing frame 1. Two end portions of the pressure roller 3 are supported and pressed against the fixing roller 2 by pressure roller bearings (not shown) and the pressing member to form a nip having a predetermined width. The halogen heater 4 is disposed within the fixing roller 2 to heat the fixing roller 2. Boss portions (not shown) of the inlet guide 5 provided at the two end portions thereof are fitted into grooves (not shown) in the fixing frame 1, by which the inlet guide 5 is supported by the fixing frame 1 in a sandwiched state. The upper cover 6 and the pressure plate 7 are mounted on the fixing frame 1. The paper discharge guide 8 and the connector 9 are mounted on the pressure plate 7. The separation guide 10 is mounted on the fixing frame 1 in such a manner as to be rotatable about a center 10*c*. The separation guide 10 extends over the entire area of the fixing roller in the longitudinal direction thereof (in a direction perpendicular to the surface of the paper).

A recording material P on which a non-fixed image is carried is conveyed through the nip between the fixing roller 2 and the pressure roller 3, during which the image is fixed utilizing heat and pressure.

After having passed through the nip, the recording material P is separated by means of the separation guide 10 spaced by a predetermined fine gap from the fixing roller 2 which makes contact with the non-fixed image.

If the gap between the separation guide 10 and the fixing roller 2 is too large, separation of the recording material P may not occur. Alternatively, the forward end portion of the recording material P may be caught by the distal end portion of the separation guide 10, generating folding of the end portion of the recording material P or jam of the recording material.

Such problems readily occur with a recording material having the maximum size which ensures the maximum image forming area.

Hence, in the present embodiment, each of the bearings 11 and 12 has a recording material guiding portion 11*a* or 12*a* which extends to reach within the maximum recording material passage area corresponding to the width of a recording material having the maximum size that the electrophotographic or electrostatic recording device can handle and which extends over more than half the circumference of the roller. The recording material guide portion has at each of two end portions thereof a sharp recording material separating portion 11*b* for separating the recording material.

The two end portions of the recording material P can be reliably separated from the fixing roller 2 by means of the recording material separating portions 11*b*. Consequently, folding or jam of the recording material P can be prevented.

Furthermore, it is not necessary for the contact pressure or contact state of the recording material separating portion to be adjusted, unlike the separation claw.

To maintain the fine gap between the fixing roller 2 and the separation guide 10, the separation guide 10 is positioned with contact portions 10*b* provided at the two end portions thereof being brought into contact with the fixing roller bearings 11 and 12. A forward claw 10*a* of the separation guide 10 is located at a position where it does not interfere with the fixing roller bearings 11 and 12.

Furthermore, although the recording material guiding portion of the bearing extends to reach within the maximum recording material passage area, it is located outside of the maximum image area in which a toner image is formed.

Consequently, the surface of the fixing roller 2 may be damaged by the toner attached thereto, causing fixing failure.

Furthermore, the recording material separating portion of the bearing is located on the upstream side of the separating portion of the separation guide 10 with respect to the direction of rotation of the roller, i.e., closer to the nip, so as to reduce an angle 'x' between a straight line which connects the center of the fixing roller to the center of the pressure roller and a straight line which connects the center of the fixing roller and a point where the recording material P is separated from the surface of the fixing roller. Consequently, curling of the recording material P can be reduced.

Figure 6:
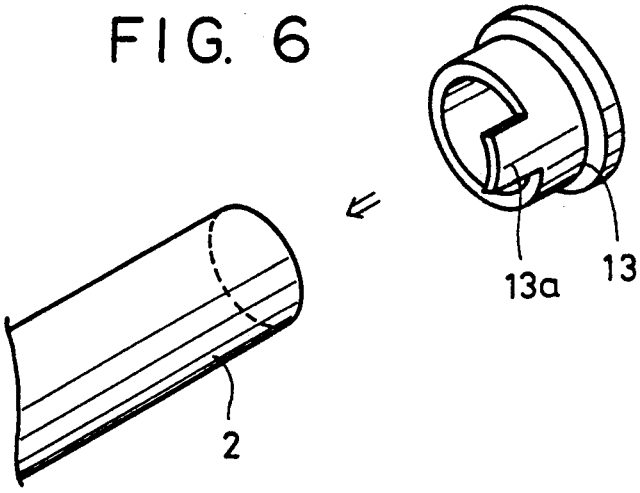
FIG. 6 is a perspective view of a bearing used in another embodiment of the present invention.

FIG. 6 shows another example of the fixing roller bearing. As shown in FIG. 6, a fixing roller bearing 13 may have a recording material guiding portion 13*a* which extends over less than half of the circumference of the roller.

In that case, however, there is the possibility that the recording material guiding portion 13*a* warp in an outward direction. To eliminate such a possibility, the separation guide 10 is brought into contact with the recording material guiding portion 13*a* so as to allow the recording material guide portion 13*a* to be pressed against the fixing roller 2.

Figure 7:
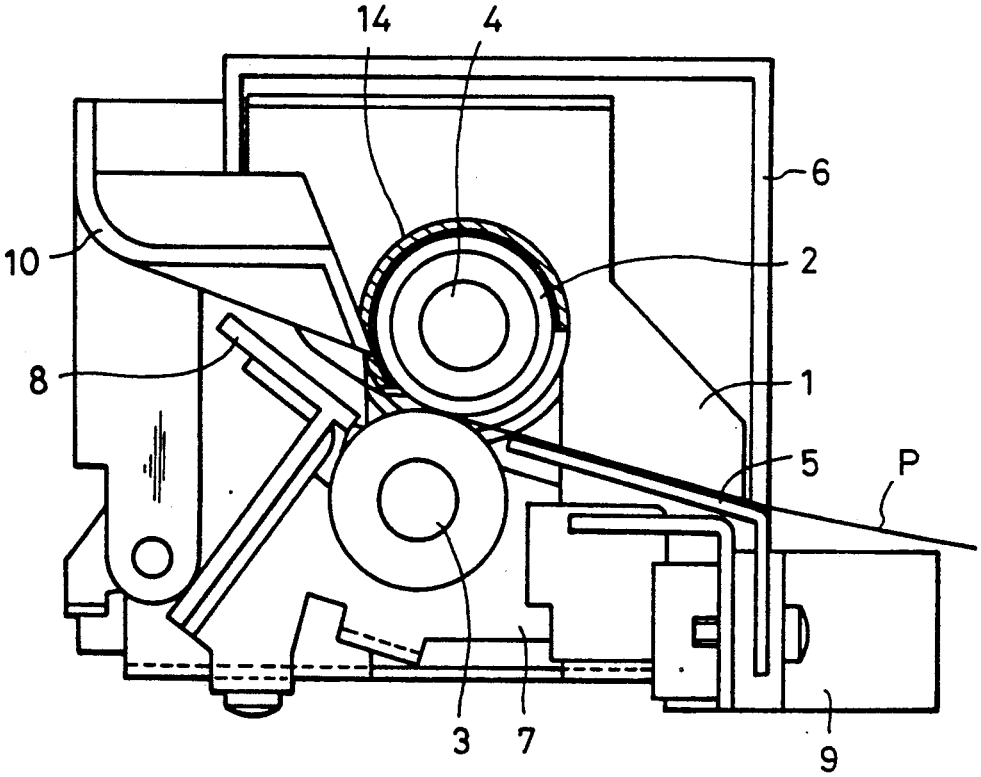
FIG. 7 is a cross sectional view of a second embodiment of the fixing device according to the present invention.
Figure 8:
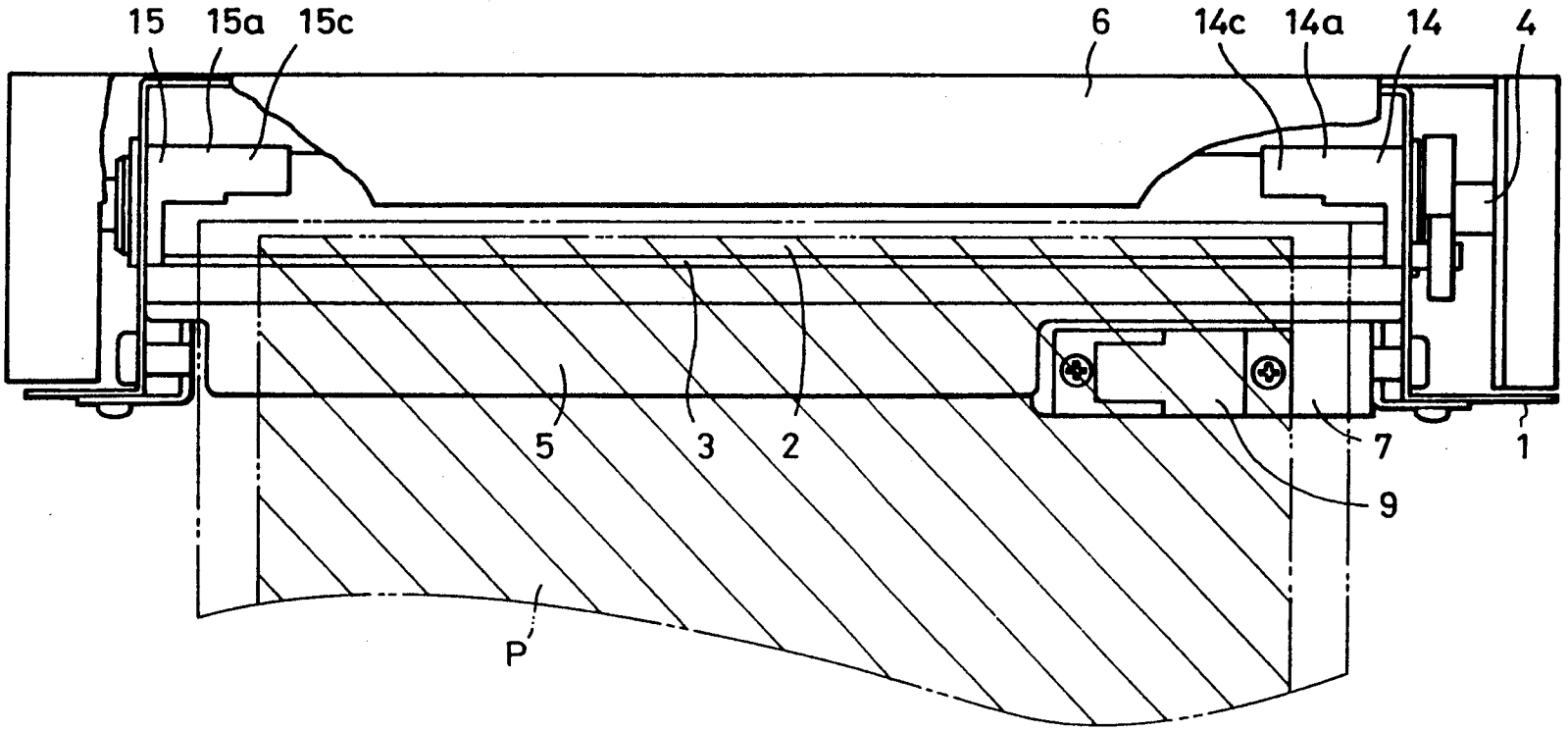
FIG. 8 is a front view of the fixing device shown in FIG. 7.

A second embodiment of the present invention will be described below with reference to FIGS. 7 and 8. In this embodiment, the inner diameter of each of the bearings for rotatably supporting the fixing roller has a shoulder. FIG. 7 is a cross-sectional view of a fixing device. FIG. 8 is a front view of the fixing device. The same reference numerals are used to denote parts or components which are identical to those of the aforementioned embodiment, a description thereof being omitted.

Fixing roller bearings 14 and 15 rotatably support the fixing roller 2. The fixing roller bearings 14 and 15 respectively have recording material guiding portions 14*a* and 15*a* which extend to reach within the image forming area and whose inner diameter has a shoulder. The recording material guiding portions 14*a* and 15*a* are brought into contact with the fixing roller 2 in the non image forming area of the recording material P to rotatably support the fixing roller 2. The 14C portion has a larger inner diameter and is not in contact with the fixing roller 2. Hence, the fixing roller bearings are not in contact with the fixing roller 2 within the image forming area (a hatched portion shown in FIG. 8). Since the fixing roller bearings 14 and 15 are provided coaxially with respect to the fixing roller, a fine gap between the bearings and the fixing roller 2 can be accurately controlled.

The fixing roller bearings 14 and 15 make contact with the recording material over a wider length. This allows occurrence of curling to be further reduced.

A third embodiment of the present invention will be described below with reference to FIGS. 9 and 10. In this embodiment, the separation guide has a shape which corresponds to the recording material having a small size.

Figure 9:
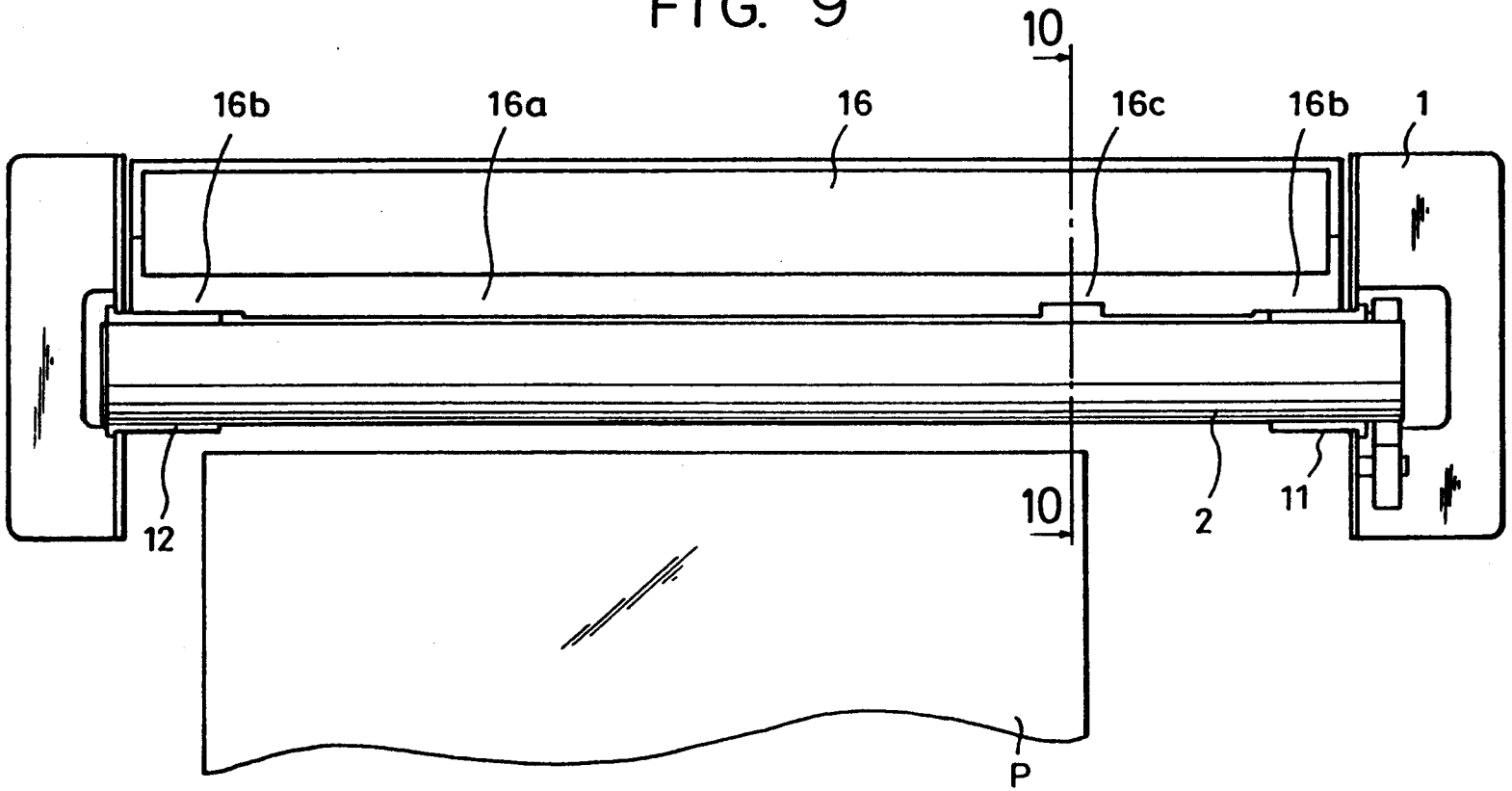
FIG. 9 is a plan view of a third embodiment of the fixing device according to the present invention.
Figure 10:
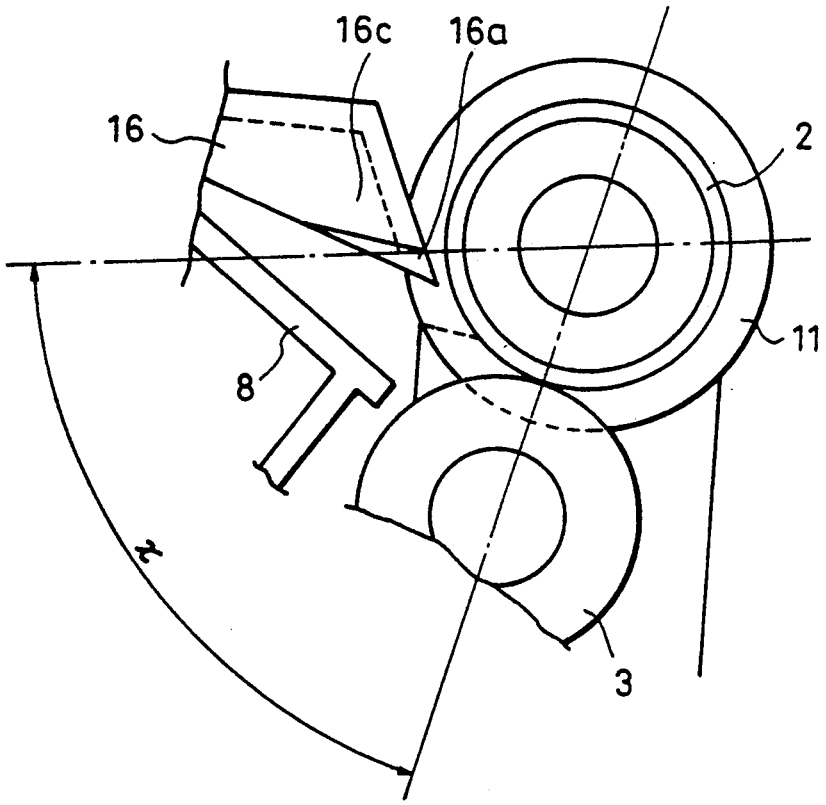
FIG. 10 is a section taken along a line A—A of FIG. 9.

FIG. 9 is a plan view of the fixing device. FIG. 10 is a section taken along a line A—A of FIG. 9. The same reference numerals are used to denote parts or components which are identical to those of the aforementioned embodiments, a description thereof being omitted.

A separation guide 16 is disposed at a position spaced from the fixing roller 2 by a predetermined fine gap.

Where a transfer material having a small size is to be separated from the fixing roller, the right end portion of the transfer material P, as viewed in FIG. 9, cannot be separated from the fixing roller 2 by the fixing roller bearing, although the left end portion thereof can be separated by the fixing roller bearing 12, as shown in FIG. 9. Hence, a claw portion 16*a* of the separation guide 16 has a claw portion 16*c* which is a shoulder, as shown in FIG. 10 so as to increase the angle x and thereby prevent folding of the end of the recording material P. Also, the fine gap between the separation guide 16 and the fixing roller 2 is determined by the contact of contact portions 16*b* provided at the two sides of the separation guide 16 with the fixing roller bearings 11 and 12.

Figure 11:
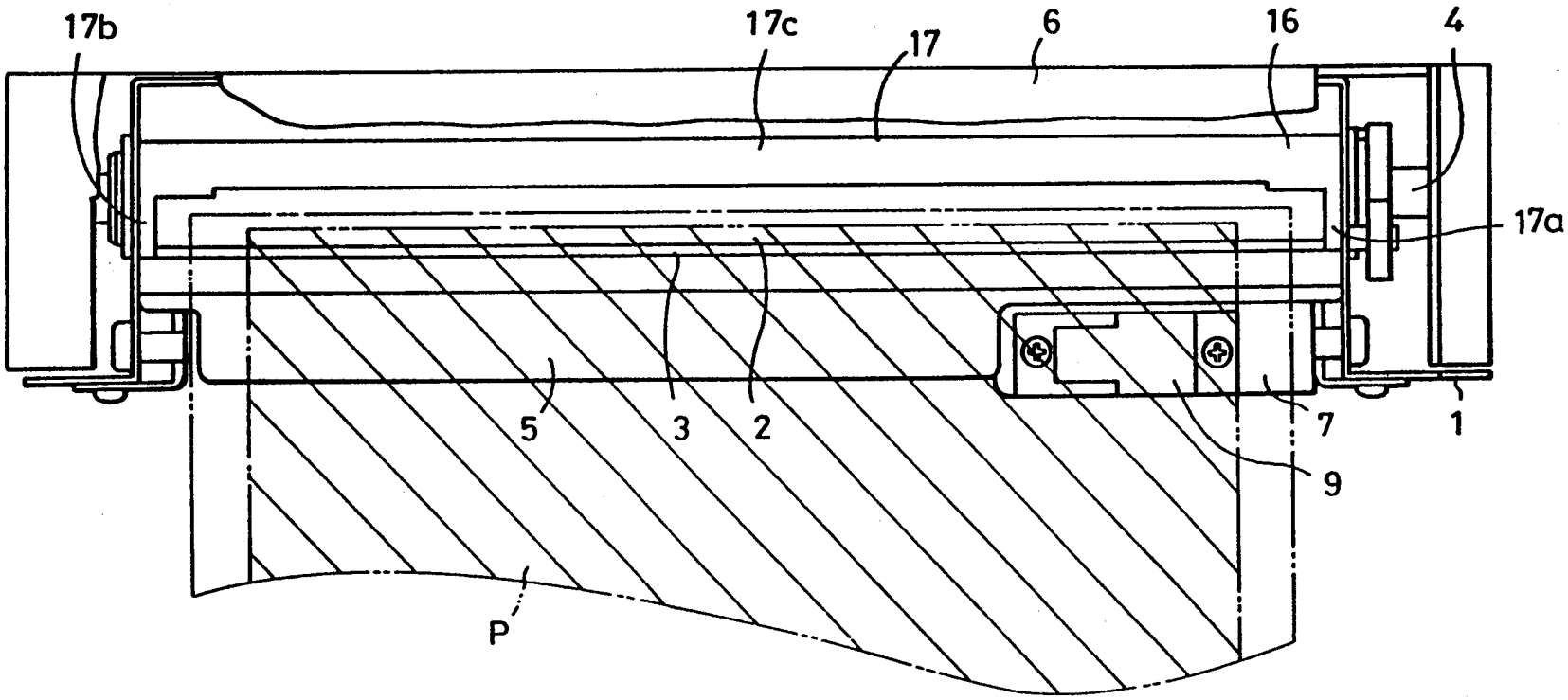
FIG. 11 is a front view of a fourth embodiment of the fixing device according to the present invention.
Figure 12:
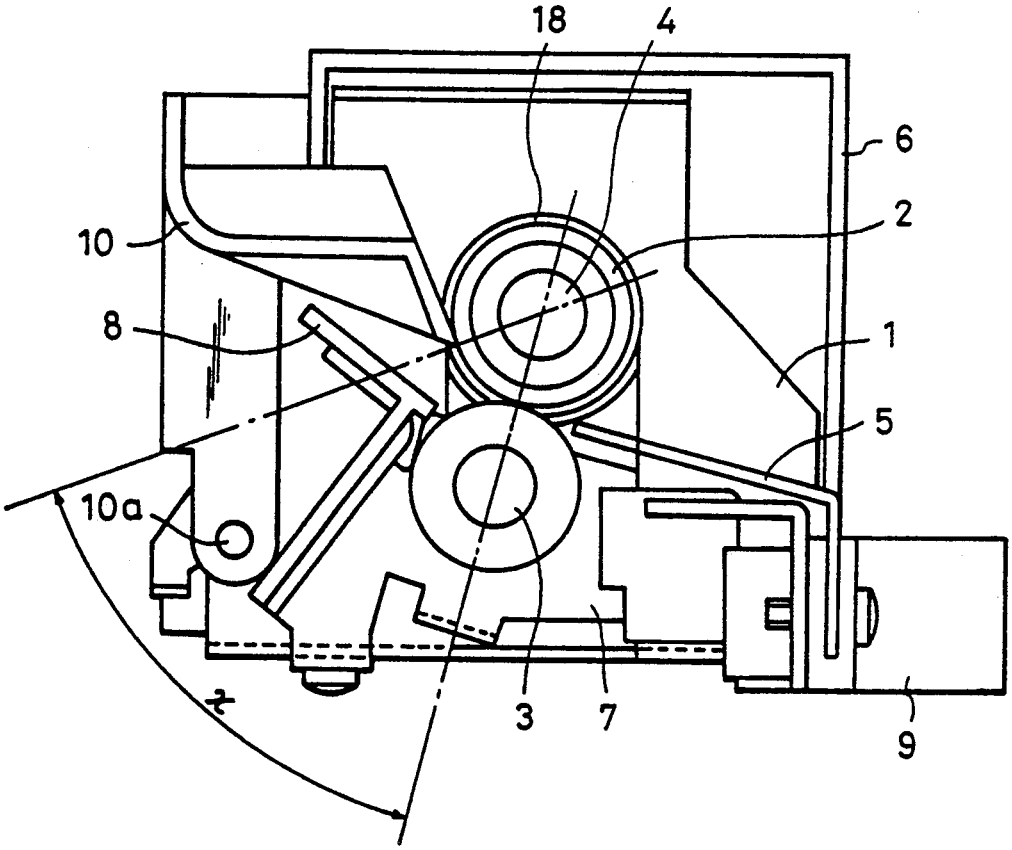
FIG. 12 PRIOR ART
FIG. 12 is a cross-sectional view of a conventional fixing device.

FIG. 11 shows a fourth embodiment of the present invention.

In this embodiment, the bearings for rotatably supporting the fixing roller are made of a single member. FIG. 11 is a front view of the fixing device. The same reference numerals are used to denote parts or components which are identical to those of the aforementioned embodiments, description thereof being omitted.

A fixing roller bearing 17 for rotatably supporting the fixing roller 2 has fixing roller supporting portions 17*a* and 17*b* at the two sides thereof. These fixing roller supporting portions 17*a* and 17*b* are connected to each other by a recording material guiding portion 17*c*. The fixing roller bearing 17 is formed by molding. The inner diameter of the guiding portion 17*c* has a shoulder, like the fixing roller bearing shown in FIGS. 8 and 9. Hence, the fixing roller bearing 17 is in contact with the fixing roller 2 in the non image forming area, and is not in contact with the fixing roller 2 in the image forming area. Consequently, there is no possibility that the surface of the fixing roller 2 in the image forming area be damaged. The fine gap required to separate the recording material P can readily be maintained, because it is the distance between the fixing roller 2 and the fixing roller bearing 17 provided coaxially with respect to the fixing roller 2.

Having described the invention as related to the embodiments shown in the accompanying drawings, it is to be understood that the invention is not so limited and that it should be constructed within its spirit and scope of the appended claims.

What is claimed is:

1. An image fixing device, comprising:
a fixing roller;
a bearing for rotatably supporting said fixing roller, wherein a portion of said bearing extends into a maximum recording material passage area of said fixing roller; and
a backup member which forms a nip with said fixing roller.

2. The image fixing device according to claim 1, wherein said bearing is a slide bearing for slidably supporting said fixing roller.

3. The image fixing device according to claim 1, wherein said bearing has a recording material separating portion having a sharp end.

4. The image fixing device according to claim 3, further comprising a separation guide, provided at a position spaced from a surface of said fixing roller, for separating a recording material from said fixing roller, said bearing separating an end portion of the recording material at a position which is upstream of said separation guide with respect to a direction of rotation of said fixing roller.

5. The image fixing device according to claim 4, wherein said separation guide is positioned for separating a recording material from said fixing roller as a result of contact with said bearing.

6. The image fixing device according to claim 1, further comprising heating means for heating said fixing roller, and wherein said bearing is made of a heat-resistant resin.

7. The image fixing device according to claim 1, wherein a non-fixed image on the recording material is fixed utilizing heat and pressure.

8. A fixing roller rotatably supported by a bearing, a portion of said bearing extending into a maximum recording material passage area of the fixing roller.

9. The fixing roller according to claim 8, wherein said bearing is a slide bearing for slidably supporting the fixing roller.

10. The fixing roller according to claim 8, wherein said bearing has a recording material separating portion having a sharp end, the sharp end being that end of the bearing closest to the longitudinal center of the fixing roller.

11. The fixing roller according to claim 8, further comprising a heating means for heating the fixing roller wherein said bearing is made of a heat-resistant resin.

* * * * *

UNITED STATES PATENT AND TRADEMARK OFFICE

CERTIFICATE OF CORRECTION

PATENT NO. : 5,287,156

DATED : February 15, 1994

INVENTOR(S) : Makoto Shikada, et. al.

It is certified that error appears in the above-indentified patent and that said Letters Patent is hereby corrected as shown below:

Title page, item [56], under References Cited, insert --4,737,818 4/1988 Tanaka, et. al.

Title page, item [56], under Foreign Patent Documents, insert--
0382189 8/1990 European Patent Office
3432189 3/1985 Germany
63-148285 6/1988 Japan
1-191183 8/1989 Japan--.

Column 4, line 45, "14C portion" should read --14c portion--.

Signed and Sealed this

Ninth Day of August, 1994

Bruce Lehman

*Attest:*

BRUCE LEHMAN

*Attesting Officer*

*Commissioner of Patents and Trademarks*